United States Patent [19]

McDonough

[11] 4,164,853

[45] Aug. 21, 1979

[54] COOLER

[76] Inventor: John McDonough, 1820 Dagmar Ave., Pittsburgh, Pa. 15216

[21] Appl. No.: 782,933

[22] Filed: Mar. 30, 1977

[51] Int. Cl.[2] ..... F25D 3/08

[52] U.S. Cl. ..... 62/457; 62/389

[58] Field of Search ..... 62/457, 389

[56] References Cited

U.S. PATENT DOCUMENTS

| | | | |
|---|---|---|---|
| 198,568 | 12/1877 | Byram | 62/457 |
| 2,109,259 | 2/1938 | Yirawa | 62/457 |
| 2,917,906 | 12/1959 | Woolley | 62/457 |
| 3,178,896 | 4/1965 | Sandsto | 62/389 |
| 3,308,068 | 8/1967 | Piker | 62/464 |
| 3,308,636 | 3/1967 | Schaaf | 62/457 |
| 3,443,397 | 5/1969 | Donovan et al. | 62/457 |
| 3,614,875 | 10/1971 | McCallun | 62/457 |
| 4,006,606 | 2/1977 | Underdue | 62/457 |

*Primary Examiner*—Ronald C. Capossela

*Attorney, Agent, or Firm*—Webb, Burden, Robinson & Webb

[57] ABSTRACT

A cooler for barrels of beer is comprised of a container which supports the barrel and has a sufficient volume to envelope the barrel and is adapted to contain a cooling media. The container has a top and bottom which are removably sealable to isolate the barrel of beer from the atmosphere. Insulation means are provided to encompass the beer barrel. Means for pressurizing and withdrawing the beer are provided which are external to the container. The cooler is self-contained and is portable.

5 Claims, 3 Drawing Figures

COOLER

BACKGROUND OF THE INVENTION

1. Field of the Invention

This invention relates to beverage coolers and more particularly to portable coolers for barrels of beer.

2. Description of the Prior Art

Beer is supplied to the consumer in bottles, cans and barrels which hold various quantities of beer adapted to the consumption of a particular buyer. Primarily, the individual consumer, as opposed to taverns and the like, buys beer in bottles or cans because the barrels which hold large quantities of beer are difficult to keep cold. Thus, barrels of beer have been only used by taverns and the like which have sophisticated cooling systems and by large groups such as picnics or parties where large quantities of beer will be consumed within a single day.

Barrels of beer generally have capacities of 7.75 gallons and 15.50 gallons for one-quarter and one-half kegs respectively. Therefore, those buying beer for picnics, parties, etc. must be supplied with containers to hold the barrels along with sufficient ice to maintain the beer at the desired temperature for the duration of the party, picnic, etc. The containers for the barrels usually are either one-half 55 gallon drums or large wash tubs. These containers are large and cumbersome and ice melts rapidly due to its exposure to ambient temperatures.

Another problem associated with individuals buying beer in barrels is that if all the beer is not consumed at the party, picnic, etc., it must be discarded since it is too difficult to keep cold over a long period of time and is not maintained under constant pressure.

Solutions to the many problems involved with cooling beer have been proposed, however, none have appeared to achieve mass consumer acceptance. Illustrative of such devices are those shown in U.S. Pat. Nos. 3,614,875; 3,338,068; 3,308,636 and 2,917,906.

In accordance with the present invention a cooler is provided with portability for moving the barrel easily.

Further, the invention provides a cooler which will maintain the desired temperature and pressure of the beer over a long period of time with minimal cooling media.

BRIEF DESCRIPTION OF THE INVENTION

A cooler for barrels of beer is comprised of a container which supports the barrel and has a sufficient volume to envelope the barrel and is adapted to contain a cooling media. The container has a top and bottom which are removably sealable to isolate the barrel of beer from the atmosphere. Insulation means are provided to encompass the beer barrel. Means for pressurizing and withdrawing the beer are provided which are external to the container. The cooler is self-contained and is portable.

In addition the cooler may be mounted on wheels to provide ease of transportation from place to place.

The container interior is preferably generally cylindrical to approximate the shape of the barrel with reinforcing ribs to provide rigidity and strength for supporting the barrel. The insulation may be provided by either constructing the container itself from plastic foam such as polyurethane or polystyrene foam, or by constructing the container from metal or solid plastic with such plastic foam affixed to the interior thereof.

The ribs preferably have apertures therein to provide for circulation of water throughout the container.

The accompanying drawings are illustrative of one embodiment of the invention wherein like reference numerals refer to like parts whenever they occur.

DETAILED DESCRIPTION OF THE DRAWINGS

The bottom of the container 101 is constructed of rigid plastic foam such as polystyrene or polyurethane foam to provide insulation characteristics to the cooler. In the alternative the container bottom 101 may be constructed by metal or solid plastic with insulation affixed to the interior thereof. The container bottom 101 has a lip 102 which sealably fits within container top 103. Container top 103 is preferably constructed of the same material as container bottom 101.

Figure 1:
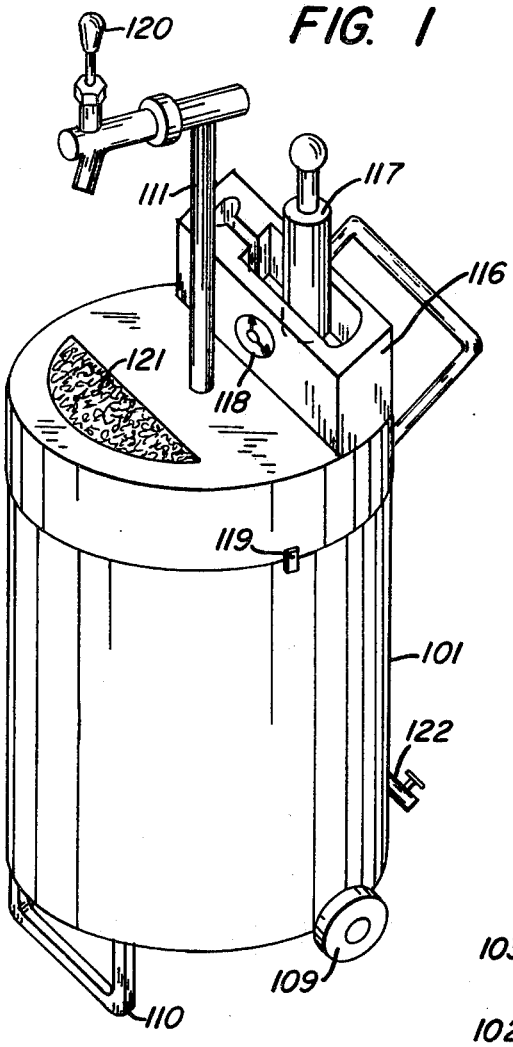
FIG. 1 is a side elevation of the cooler of the invention.
Figure 2:
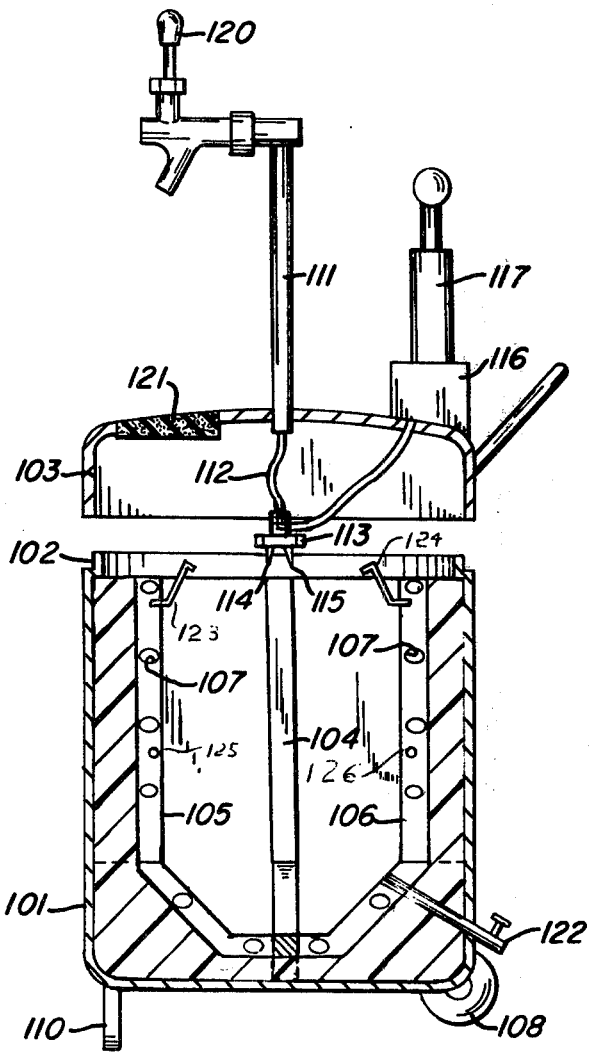
FIG. 2 is a side sectional view of the cooler of the invention.
Figure 3:
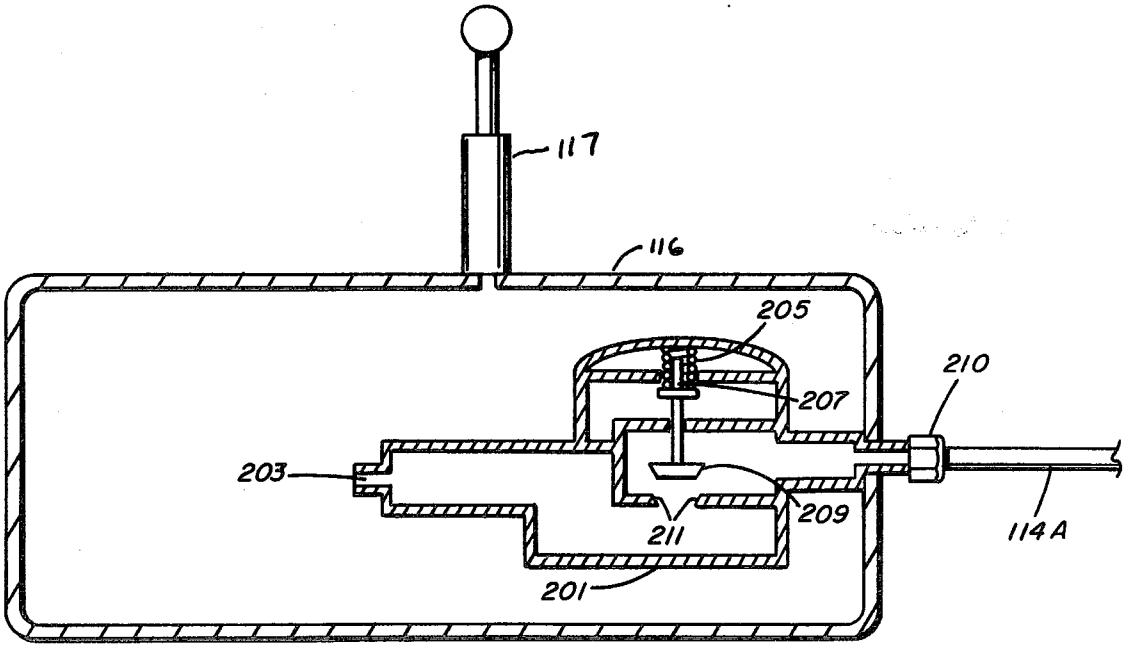
FIG. 3 shows a cross-sectional view of the pressure regulator within tank 116.

Within container bottom 101 are four support ribs (three shown) 104, 105 and 106 which provide rigidity to the container bottom and support the beer keg to be inserted therein. Each rib has a plurality of apertures 107 which allow the cooling media, preferably ice water, to circulate therethrough and cool the beer within the container. Within air hold tank 116 is a pressure regulator which maintains the keg at a constant desired pressure for adequate withdrawal of the beer. Thus the hold tank may be pressurized well above the desired level for keg pressurization, and the regulator within the hold tank will only pressurize the keg to the desired level. A pressure regulator as shown in FIG. 3 provides the desired level of pressurization for the keg as described. The pressure regulator has a housing 201 with an inlet 203 from within tank 116. Spring member 205 affixed to valve stem 207 is provided with the proper strength to open and close valve 209 in seat 211 to provide constant pressurization to the beer keg. The air flow direction is from air inlet 203 to outlet 210 which is in communication with air hose 114A.

The container bottom 101 is fitted with wheels 108 and 109 for portability to transfer the cooler from place to place. Further, container bottom 101 is fitted with support member 110 which levels the cooler to compensate for elevation due to incorporation of the wheels 108 and 109.

Feed tube 111 is sealed within top 103 and connected to flexible feed line 112. Tap fitting 113 is adopted to be inserted into the keg with feed prong 114 being the beer withdraw line and air prong 115 being the air insertion line. Air hose 114A is connected to tap fitting 113 and air hold chamber 116. Hand pump 117 is connected to air hold tank 116 and used to maintain pressure within the keg. Two clips 123 and 124 are affixed to ribs 105 and 106 to hold the beer keg in position within the container. The clips are especially useful when the keg is nearly empty and tend to float in the cooling media. Apertures 125 and 126 are also provided in ribs 105 and 106 to mount clips 123 and 124 therein when quarter barrels of beer are placed in the cooler.

The air insertion and beer withdrawal arrangement shown in the drawings is for kegs fitted with top withdrawal systems. In the event kegs with bottom beer withdrawal systems are to be used, the line 112 can be lengthened and provided with the proper fitting while line 113 can also be provided with the proper fitting for air pressurization. Sponge 121 is fitted in the top of the container to absorb any beer which is spilled during beer withdrawal. As an alternative to sponge 121 a removably insertable reservoir may be placed in the top of the container to capture spilled beer.

In a preferred operation, a beer keg is placed bottom up on a suitable surface. The container bottom 101 is placed over the beer keg so that the bottoms of ribs 104, 105 and 106 rest on the keg bottom. The container bottom 101 with the keg thereon is pivoted on wheels 108 and the keg and container 101 are placed in an upright position. Water and/or ice are placed in the container bottom in the space provided between the ribs 104, 105 and 106 and the keg wall. The adapter 113 is inserted into the suitable place in the beer keg and fixed in position. Top 103 is secured to bottom 101 by clamps 119 (other clamp not shown) to seal the top and bottom. Gauge 118 is read to determine if adequate pressure is within the keg for proper beer withdrawal. If more pressurization is necessary the pump 117 is manipulated providing pressure to air tank 116 this providing pressure to the beer keg. To withdraw beer from the keg, tap valve 120 is opened and the beer flows therefrom.

The cooler does not have to be opened after insertion of the beer keg except for the addition of more ice to maintain the temperature of the beer at the desired level. However, due to the insulation within the container the ice initially placed within the container will last for days. When water is to be drained from the interior of the cooler, outlet 122 is opened and the water is drained off.

After the party, picnic, etc., is concluded the cooler may be transported to another area for consumption of the beer over a prolonged period of time i.e. a week. The cooler of the invention maintains the beer at a consumable temperature due to the features thereof, over a substantially longer period of time as compared to similar containers for the cooling of beer at picnics, parties, etc.

What is claimed is:

1. A cooler for barrels of beer comprising:

a container to support, and having sufficient volume to envelope, a barrel of beer and adapted to contain a cooling media, said container having separable top and bottom sections which are removably sealable to isolate the barrel of beer from the atmosphere;

means for thermally insulating the interior of said container from the outside atmosphere;

means for manually pressurizing the barrel of beer external to said container including an air holding chamber in communication with said barrel of beer;

pressure regulation means associated with said air holding tank which maintains the pressure within said barrel at a predetermined level;

means for withdrawing the beer external to said container, while said top and bottom sections are sealed; and said cooler being self-contained and portable.

2. The cooler of claim 1 wherein said container is constructed of plastic insulating foam and has reinforcing ribs adapted to support a beer keg.

3. The cooler of claim 1 including wheels mounted to the bottom of said container adapted for transportation of said cooler.

4. The cooler of claim 1 wherein said means for pressurizing the barrel of beer is provided by a hand pump in connection with an air hold tank and pressure regulating means, said air tank being adapted to functionally connect to the air inlet of a beer keg.

5. The cooler of claim 1 wherein said container bottom has a plurality of support ribs therein with said means for insulating affixed to the exterior of said ribs to form said container bottom, said ribs having a plurality of apertures therein to allow a cooling media to flow through said apertures.

* * * * *